US008123217B2

(12) United States Patent
Otaka

(10) Patent No.: US 8,123,217 B2
(45) Date of Patent: Feb. 28, 2012

(54) SHEET-CONVEYING APPARATUS AND IMAGE-READING APPARATUS

(75) Inventor: Hisashi Otaka, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 12/828,755

(22) Filed: Jul. 1, 2010

(65) Prior Publication Data

US 2011/0006473 A1 Jan. 13, 2011

(30) Foreign Application Priority Data

Jul. 10, 2009 (JP) ..... 2009-163762

(51) Int. Cl.
*B65H 9/04* (2006.01)

(52) U.S. Cl. ..... 271/245; 271/244; 271/243

(58) Field of Classification Search ..... 271/234, 271/243, 244, 245, 246
See application file for complete search history.

(56) References Cited

U.S. PATENT DOCUMENTS 4,473,222 A * 9/1984 Simmons et al. ..... 271/245
6,011,948 A * 1/2000 Amano et al. ..... 399/395
6,993,268 B2 1/2006 Otaka
7,584,960 B2 * 9/2009 Ha ..... 271/246
7,681,882 B2 * 3/2010 Yu et al. ..... 271/243
7,731,175 B2 * 6/2010 Kang ..... 271/110
2008/0143045 A1 * 6/2008 Yu et al. ..... 271/245

FOREIGN PATENT DOCUMENTS

JP 05338865 A * 12/1993
JP 2000-136051 5/2000

* cited by examiner

*Primary Examiner* — Kaitlin Joerger
(74) *Attorney, Agent, or Firm* — Fitzpatrick, Cella, Harper & Scinto

(57) ABSTRACT

Provided is a sheet-conveying apparatus including: a skew-feeding correction member having an abutting portion which is brought into contact with a conveyed sheet; and a positioning portion positioning the skew-feeding correction member and having a biasing member for biasing the skew-feeding correction member to a direction opposite to a direction to which the skew-feeding correction member rotates by the sheet. The sheet-conveying apparatus is set so that a formula $M+M_S<M_A$ is established when the sheet is pulled out, wherein a moment generated in the skew-feeding correction member due to a resultant force of tensions to upstream and downstream sides is assumed to be $M_A$, a moment generated in the skew-feeding correction member due to a frictional force between the skew-feeding correction member and the sheet is assumed to be M, and a moment generated in the skew-feeding correction member due to the biasing member is assumed to be $M_S$.

8 Claims, 4 Drawing Sheets

SHEET-CONVEYING APPARATUS AND IMAGE-READING APPARATUS

BACKGROUND OF THE INVENTION

1. Field of the Invention

The present invention relates to a sheet-conveying apparatus and an image-reading apparatus, and more particularly, to a sheet-conveying apparatus and an image-reading apparatus capable of correcting skew feeding of sheets.

2. Description of the Related Art

An image-reading apparatus includes a sheet-conveying apparatus. After sheets are sequentially fed one by one by feeding rollers, the sheet-conveying apparatus conveys each of the sheets to an image-reading portion. There is known technology for correcting skew feeding of the sheet by a skew-feeding correction portion in the sheet-conveying apparatus.

As the skew-feeding correction portion, there is known a skew-feeding correction portion which causes a leading edge of each of the conveyed sheet to conform to an abutting surface of an abutting member, to thereby correct the skew feeding of the sheet (see Japanese Patent Application Laid-Open No. 2000-136051). In the above-mentioned type, since a drive controlling system is unnecessary to correct the skew feeding of the sheet, the skew-feeding correction portion is low cost. In addition, due to a simple structure of the skew-feeding correction portion, the cost and size can be reduced.

The leading edge of each of the conveyed sheets is caused to conform to the abutting surface of the abutting member (skew-feeding correction member), to thereby correct the skew feeding of the sheet. After that, a surface of the sheet is brought into contact with the skew-feeding correction member, and the sheet causes the skew-feeding correction member to rotate, and the sheet is conveyed to a downstream side in a sheet-conveying direction. Here, in particular, in a case where the skew-feeding correction member is arranged inside of a curved conveying path, the following can be assumed. That is, when the surface of the sheet is held in contact with the skew-feeding correction member, jamming of the sheet may occur and hence the sheet conveyance must be stopped. When a user tries to pull out the sheet, which has stopped being conveyed, to an upstream side in the sheet-conveying direction, and to remove the sheet from a conveying path, the skew-feeding correction member is caused to rotate to the upstream side in the sheet-conveying direction together with the sheet. When the skew-feeding correction member is caused to rotate, the skew-feeding correction member grabs in the sheet. Therefore, it is difficult to treat the jammed sheet, and hence a jamming treatment performance decreases.

SUMMARY OF THE INVENTION

Therefore, the present invention has been made in view of the above-mentioned circumstances, and provides a sheet-conveying apparatus and an image-reading apparatus which capable of improving a jamming treatment performance in a skew-feeding correction portion.

The present invention provides a sheet-conveying apparatus, including: a pair of rotary members that conveys a sheet; a skew-feeding correction member that is provided to be rotatable coaxially with one rotary member of the pair of rotary members, that has an abutting portion with which a leading edge of the sheet conveyed toward the pair of rotary members is brought into contact for skew-feeding correction, and that is pressed by the conveyed sheet to rotate; and a positioning portion that has a biasing member for biasing the skew-feeding correction member to a direction opposite to a direction to which the skew-feeding correction member is pressed by the sheet to rotate, and that positions the skew-feeding correction member at a stand-by position at which the abutting portion abuts against the sheet upstream in a sheet-conveying direction with respect to a nip portion of the pair of rotary members, wherein the sheet-conveying apparatus is set so that, in order to pull out the sheet while preventing the skew-feeding correction member from rotating to a direction opposite to the sheet-conveying direction together with the sheet to be pulled out when the stopped sheet is pulled out to the direction opposite to the sheet-conveying direction under a state in which the skew-feeding correction member is caused to rotate from the stand-by position, the following formula is established:

$$M+M_S<M_A$$

wherein a moment generated in the skew-feeding correction member due to a resultant force of a tension to an upstream side in the sheet-conveying direction and of a tension to a downstream side in the sheet-conveying direction when the sheet is pulled out is assumed to be $M_A$, wherein a moment generated in the skew-feeding correction member due to a frictional force between the skew-feeding correction member and the sheet when the sheet is pulled out is assumed to be M, and wherein a moment generated in the skew-feeding correction member due to the biasing member when the sheet is pulled out is assumed to be $M_S$.

As in a case of the present invention, when the stopped sheet is pulled out in a state in which the skew-feeding correction member is normally caused to rotate, the sheet is enabled to be pulled out while preventing the skew-feeding correction member from rotating to the same direction as the sheet. Thus, it is possible to improve a jamming treatment performance in the skew-feeding correction member portion.

Further features of the present invention will become apparent from the following description of exemplary embodiments with reference to the attached drawings.

DESCRIPTION OF THE EMBODIMENTS

Figure 1:
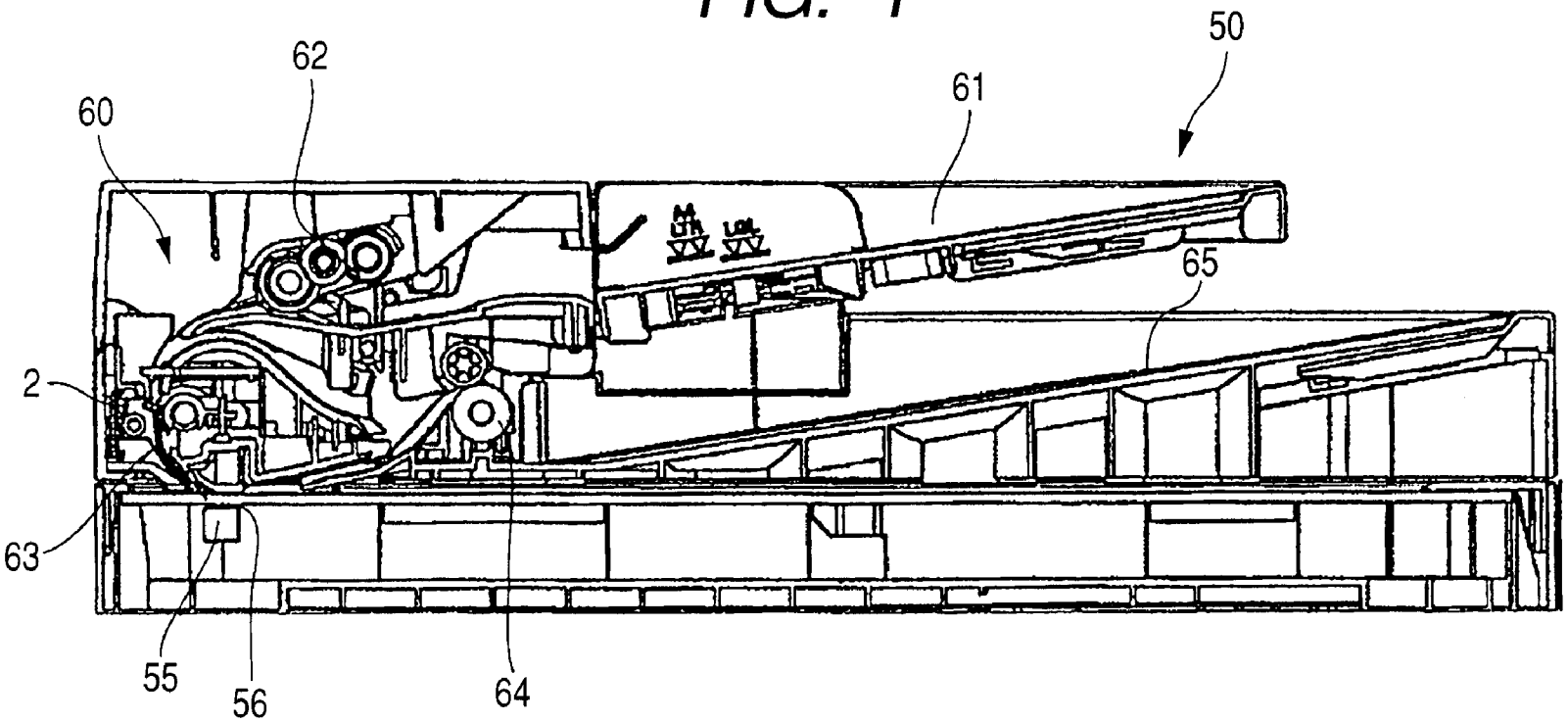
FIG. 1 illustrates a structure of an image-reading apparatus including a sheet-conveying apparatus according to an embodiment of the present invention.

Hereinafter, an embodiment of the present invention is described in detail with reference to the drawings. FIG. 1 illustrates a structure of an image-reading apparatus including a sheet-conveying apparatus according to an embodiment of the present invention. In FIG. 1, the image-reading apparatus 50 includes a reading sensor 55 constituting an image-reading portion and an ADF (auto document feeder) 60 serving as the sheet-conveying apparatus. The reading sensor 55 irradiates an image information surface of an original with a light emitted from a light-emitting diode (LED) array serving as a light source. Then, the light is reflected on the image information surface, and the reflected light is imaged in a sensor element through a SELFOC Lens (trademark). In this manner, the reading sensor 55 reads image information. The reading sensor 55 is movable in an original-conveying direction. When the reading sensor 55 reads an image of a stationary original, the reading sensor 55 scans the right side of FIG. 1 to read the image of the original. When the reading sensor 55 flow-reads an original conveyed by the ADF 60, the reading sensor 55 reads the conveyed original under a state in which the reading sensor 55 is fixed at a lower position of a platen glass 56 illustrated in FIG. 1.

The ADF 60 includes a separation feeding portion 62 and conveying roller pairs 2. The separation feeding portion 62 separates one by one originals from the original sheets stacked on an original stacking table 61, beginning at the top of the stack of the originals. Then, the separation feeding portion 62 feeds each of the originals. The conveying roller pairs 2 convey each of the originals separated by the separation feeding portion 62 so that each of the originals passes through over the reading sensor 55. An original-conveying path (sheet-conveying path) 63 includes the conveying roller pairs 2 arranged therein and is curved. In the curved original-conveying path 63, there are arranged an original presence or absence sensor (not shown) for detecting the presence and absence of the original, a sheet discharge roller pair 64, and the like.

In the image-reading apparatus 50, when each of the originals are read by flow-reading, an operator stacks the originals on the original stacking table 61, and instructs reading start through an operating portion (not shown). Then, the originals are separated and fed one by one by the separation feeding portion 62 serving as a conveying portion for conveying the sheet. After that, the original is conveyed by the conveying roller pairs 2 along the original-conveying path 63 to an image reading position arranged above the reading sensor 55. Then, reading of the image information by the reading sensor 55 is started. Next, the original, the image of which has been read, is fed toward the sheet discharge roller pair 64, and is discharged by the sheet discharge roller pair 64 onto a sheet discharge tray 65.

Figure 2:
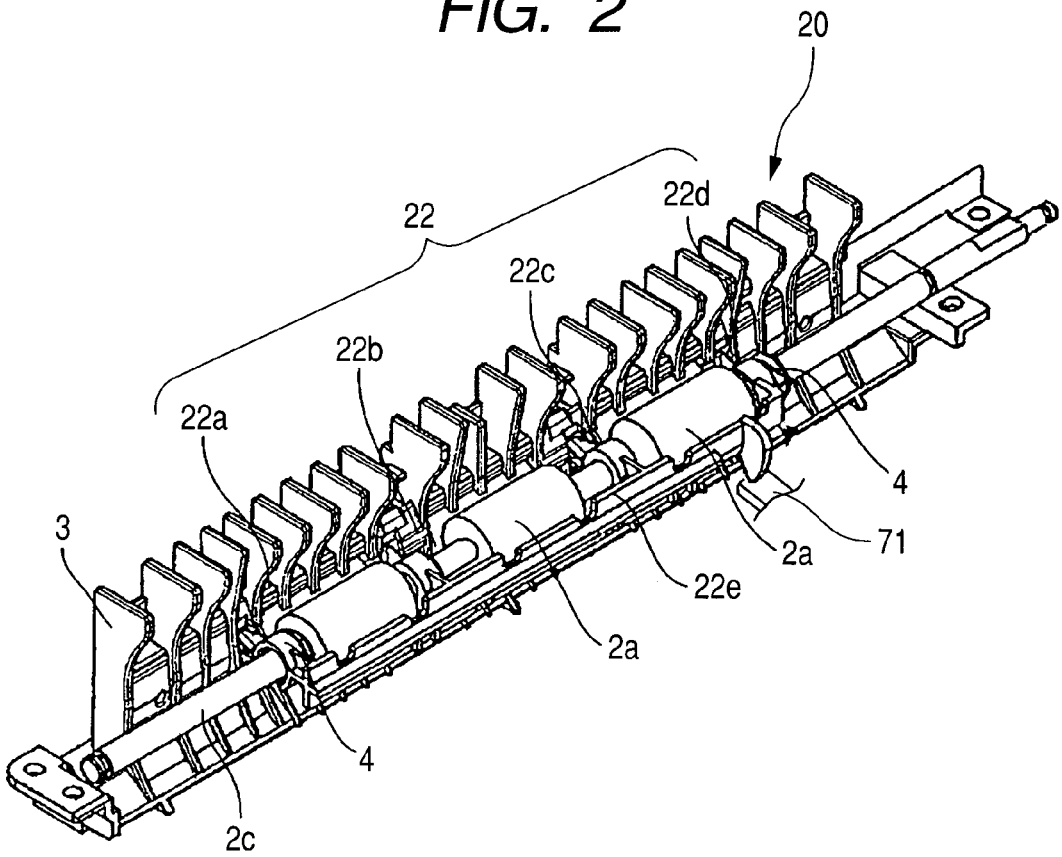
FIG. 2 illustrates a structure of a registration shutter unit provided in an auto document feeder (ADF) serving as the sheet-conveying apparatus.

The image-reading apparatus 50 includes, in the curved original-conveying path 63, a registration shutter unit 20 illustrated in FIG. 2. The registration shutter unit 20 serves as a skew-feeding correction portion for correcting skew feeding of the original. The registration shutter unit 20 includes driving rollers 2*a* and driven rollers 2*b*. The driving rollers 2*a* and the driven rollers 2*b* constitute the conveying roller pairs 2 serving as a pair of rotary members for conveying the original. The driving rollers 2*a* and the driven rollers 2*b* are capable of setting a nip pressure to a certain value through a mechanism (not shown) for pressing the driven rollers 2*b* onto the driving rollers 2*a*.

The registration shutter unit 20 includes registration shutters 21 serving as skew-feeding correction members. The registration shutters 21 are constantly biased by helical torsion coil springs 4 serving as biasing members to a direction (direction indicated by the arrow G) opposite to the original-conveying direction (sheet-conveying direction) in FIGS. 3A and 3B. The registration shutters 21 are held to a driving shaft 2*c* of the driving rollers 2*a* so as to be rotatable coaxially with the driving rollers 2*a*. The registration shutters 21 include a plurality of shutter claws 22 (22*a* to 22*d*). A plurality of shutter claws 22 (22*a* to 22*d*) serves as abutting portions for abutting against the sheet conveyed toward the conveying roller pairs 2. A plurality of shutter claws 22 is coupled through a coupling plate 22*e*, and hence rotates integrally with each other. The registration shutters 21 are normally biased by the helical torsion coil springs 4, and hence the coupling plate 22*e* of the registration shutters 21 abuts against a stopper 71. The shutter claws are, on the upstream side in the original-conveying direction with respect to nip portions of the conveying roller pairs 2, held in a stand-by state in which the shutter claws 22 are substantially perpendicular to the original-conveying direction in the original-conveying path 63. That is, typically, the registration shutters 21 abut against the stopper 71 due to a biasing force of the helical torsion coil springs 4. The shutter claws 22 are held in a stand-by position in which the shutter claws 22 are positioned on the upstream side in the original-conveying direction (on the upstream side in the sheet-conveying direction) with respect to the nip portions of the conveying roller pairs 2 illustrated in FIG. 3A. In this embodiment, the stopper 71 and the helical torsion coil springs 4 constitute a positioning portion for positioning the registration shutters 21 in the stand-by position. Here, a mode of biasing the registration shutters 21 through elastic members such as the helical torsion coil springs 4 is exemplified. However, without using the elastic members such as the helical torsion coil springs 4, weight members serving as biasing members may be attached to the registration shutters 21, to thereby bias the registration shutters 21 with self-weight of the weight members. The above-mentioned weight members may include, for example, the coupling plate 22*e* itself. In other words, the coupling plate may be used as a biasing member for biasing the registration shutters 21 with self-weight of the coupling plate 22*e*.

Figure 3A:
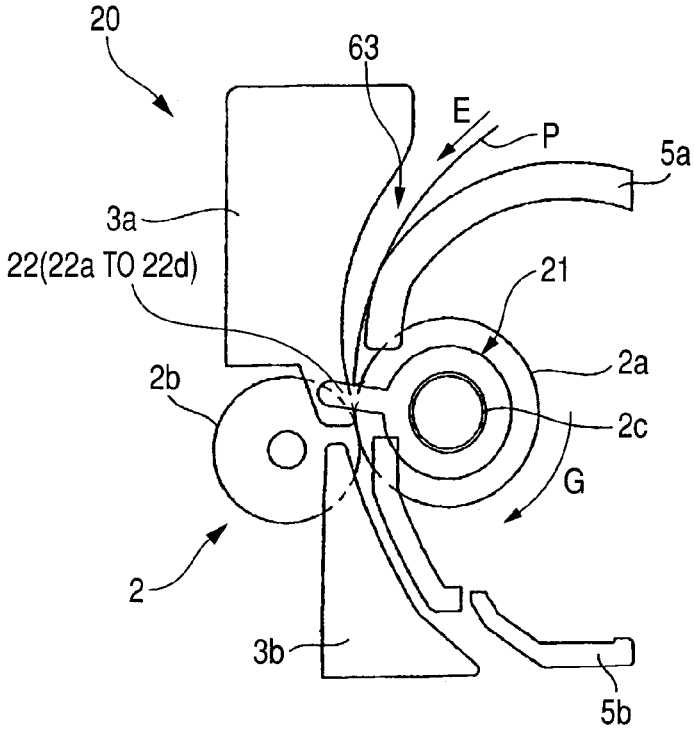
FIGS. 3A and 3B illustrate an operation of the registration shutter unit.

In the registration shutter unit 20, when an original P is conveyed by the separation feeding portion 62 from a direction indicated by the arrow E of FIG. 3A, a leading edge of the original is brought into contact with the shutter claws 22 of the registration shutters 21. When the original P is skew-fed, an edge on a leading side of the original P is brought into contact with the shutter claw 22 of the shutter claws 22 of the registration shutters 21, for example, the shutter claw 22*d* of FIG. 2, which is arranged at one end portion in a width direction being orthogonal to the original-conveying direction. As a result, the original P forms a loop. After that, when the original P is further conveyed, the skewing original P is conveyed while enlarging the loop in the original-conveying path 63. When the loop is enlarged beyond a predetermined amount, due to the stiffness of the original P, the skewing original P conforms to all of the shutter claws 22. In this manner, skew feeding is corrected.

Figure 3B:
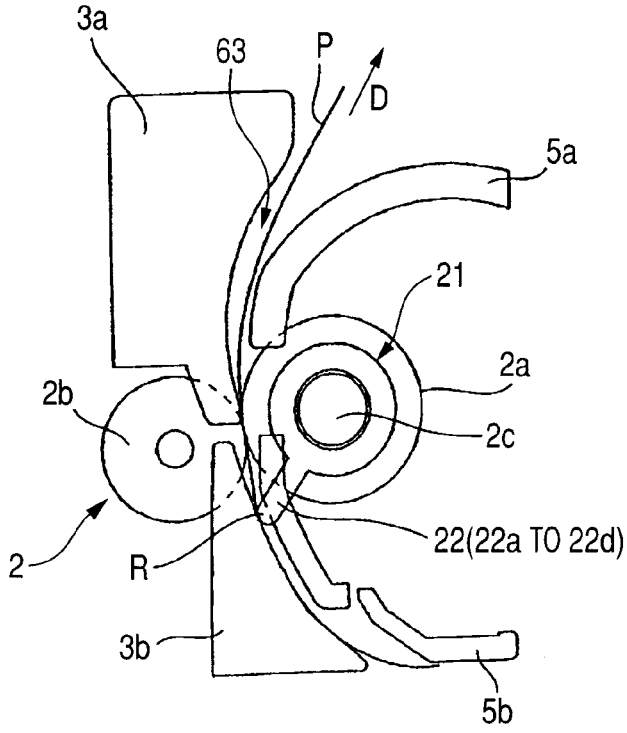

When the skew feeding of the original P is corrected and a force to a travelling direction of the original P exceeds a reaction force (biasing force) of the helical torsion coil springs 4, the original P presses the registration shutters 21, and hence the registration shutters 21 are caused to rotate to the original-conveying direction. That is, the leading edge of the original causes, against the biasing force of the helical torsion coil springs 4, the registration shutters 21 to rotate. After the skew feeding is corrected, the leading edge of the original P arrives at the nip of the conveying roller pairs 2 while causing the registration shutters 21 to rotate. After that, the original is conveyed by the conveying roller pairs 2 to the image reading position. Immediately after the leading edge of the original P is nipped by the conveying roller pairs 2, the original conveyed by the conveying roller pairs 2 presses the registration shutters 21, and hence the registration shutters 21 are caused to further rotate to the original-conveying direction. With this, when the original P is conveyed by the conveying roller pairs 2, as illustrated in FIG. 3B, tip portions of the shutter claws 22 are positioned on the downstream side with respect to the nip portions of the conveying roller pairs 2. When a trailing edge of the original P passes through the registration shutters 21, the registration shutters 21 are returned, due to the helical torsion coil springs 4, to the stand-by position illustrated in FIG. 3A.

In this embodiment, as illustrated in FIGS. 3A and 3B, the registration shutters 21 rotate about the driving shaft 2*c* of the driving rollers 2*a* arranged in an inside of the original-conveying path 63. The registration shutters 21 are provided in the inside of the original-conveying path 63, in a space between the separation feeding portion 62 and the image reading position. The separation feeding portion 62 is provided above the registration shutters 21, and the image reading position is provided below the registration shutters 21. With this, a reduction in size of the image-reading apparatus 50 is allowed. If the driving shaft of the driven rollers 2*b* is provided with the registration shutters 21, the size in a width direction of the image-reading apparatus 50 is increased in order to ensure a space for arranging the registration shutters 21. The registration shutters 21 are arranged in the above-mentioned position as in this embodiment, and hence the space can be efficiently used, and a reduction in size of the image-reading apparatus 50 can be achieved. In FIGS. 3A and 3B, an upper outside guide rib 3*a* and a lower outside guide rib 3*b* are provided in the curved original-conveying path 63, and an upper inside guide rib 5*a* and a lower inside guide rib 5*b* form the original-conveying path 63 together with the upper outside guide rib 3*a* and the lower outside guide rib 3*b*.

When the original is conveyed while causing the registration shutters 21 to rotate, jamming of the sheet may occur. In this case, a user pulls out the original according to an indication such as an operation label. At this time, the original P may be pulled out to the upstream side in the original-conveying direction (to direction indicated by the arrow D). When the original is pulled out to the direction indicated by the arrow D, if the registration shutter 21 rotates to the upstream side in the original-conveying direction (clockwise direction) together with the original, the registration shutter 21 enters between the lower outside guide ribs 3*b*, and bites in the original P, and hence it becomes more difficult to treat the jammed original P. When the original is pulled out to the direction indicated by the arrow D, if the registration shutter 21 rotates to on the upstream side in the original-conveying direction (clockwise direction) together with the original, it is assumed that the original P may be damaged by the registration shutter 21.

Figure 4A:
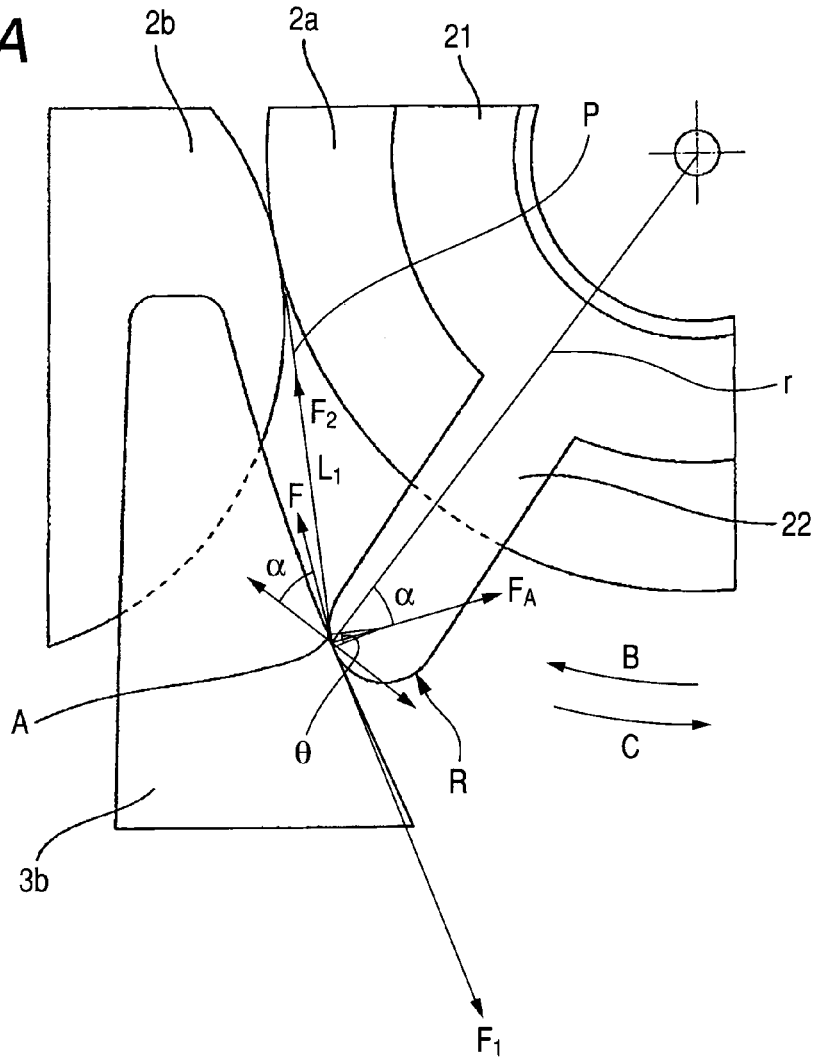
FIG. 4A illustrates forces, moments, and the like, which act on the registration shutter unit upon skew-feeding correction.

When the original P is jammed, the original P is, for example, as illustrated in FIG. 4A, nipped by the conveying roller pairs 2, and is stopped in a state in which the original P is held in contact with the lower outside guide rib 3*b* provided on the downstream side in the original-conveying direction of the conveying roller pairs 2, and with a tip R of the shutter claw 22. At this time, the original P is stopped in a state in which the original P is held in contact with the tip R of the shutter claw 22 of the registration shutter 21 from a direction of a tangential line $L_1$ of the driven rollers 2*b* along the lower outside guide rib 3*b* at a winding angle θ. In a case where the original P in the above-mentioned state is tried to be pulled out, for example, when the leading edge of the original arrives at the sheet discharge roller pair 64, even if a nip pressure of the sheet discharge roller pair 64 is released, load is applied due to a frictional force between the original P and the original-conveying path 63.

Therefore, when there is an attempt to pull out the original P, in the shutter claw 22, there are generated a tension F1 to the downstream side in the original-conveying direction (tension to the downstream side in the sheet-conveying direction) due to the frictional force between the original P and the original-conveying path 63, and a tension F2 to the upstream side in the original-conveying direction (tension to the upstream side in the sheet-conveying direction). When the two tensions F1, F2 are generated, due to a resultant force FA of the two tensions F1, F2, there is generated a moment MA rotating the registration shutter 21 to a direction indicated by the arrow C. At the same time, in the shutter claw 22 (registration shutter 21), there is generated a moment M rotating the registration shutter 21 to a direction indicated by the arrow B due to a frictional force between the shutter claw 22 and the original P. Due to the helical torsion coil spring 4, in the shutter claw 22 (registration shutter 21), there is generated a moment MS rotating the registration shutter 21 to the direction indicated by the arrow B. When the above-mentioned moments are generated and the following Formula (1) is established, the registration shutter 21 does not rotate anymore to the direction indicated by the arrow B.

$$M+M_S<M_A \tag{1}$$

Figure 4B:
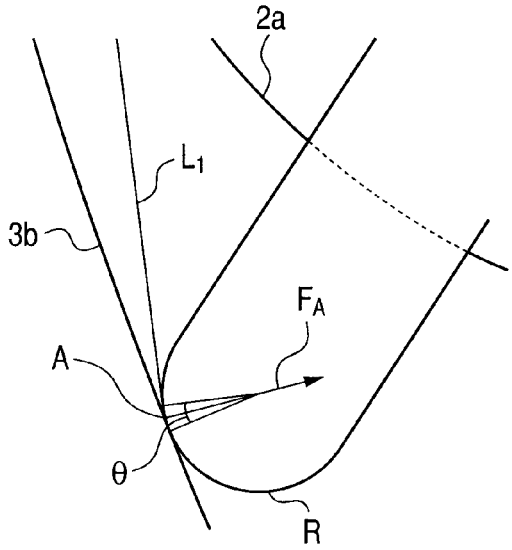
FIG. 4B illustrates an enlarged view of a tip of a shutter claw which brings into contact with an original.

FIG. 4B illustrates an enlarged view of a state in which the original P is brought into contact with the tip R of the shutter claw 22. A frictional force F between the original P and the tip R of the shutter claw 22 acts to the tangential direction of the tip R in an intermediate point A of the winding angle θ. Therefore, the moment M rotating the shutter claw 22 to a direction indicated by the arrow B due to friction with respect to the original P is represented by the following Formula (2). In the following Formula (2), a symbol r represents a length of a straight line linking a power point A of the resultant force FA and a rotational center of the registration shutter, that is, a center of the driving shaft 2*c* of the driving rollers 2*a*. In other words, the length is a length of the shutter claw 22 from the center of the driving shaft 2*c* of the driving rollers 2*a*. A symbol α represents an angle formed by the straight line r and the resultant force FA.

$$M=r\cdot F\cos\alpha \tag{2}$$

On an assumption that the straight line r and the resultant force $F_A$ form the angle α, Formula (1) is represented by the following Formula (3) or the following Formula (4).

$$r\cdot F\cos\alpha+M_S<r\cdot F_A\sin\alpha \tag{3}$$

$$r\cdot F\cos\alpha<r\cdot F_A\sin\alpha-M_S \tag{4}$$

The resultant force $F_A$ is represented by the following Formula (5).

$$F_A=F_1\cos[(\pi-\theta)/2]+F_2\cos[(\pi-\theta)/2] \tag{5}$$

With this, the above-mentioned Formula (4) is represented as follows.

$$r\cdot F\cos\alpha<r\cdot\{F_1\cos[(\pi-\theta)/2]+F_2\cos[(\pi-\theta)/2]\}\cdot\sin\alpha-M_S \tag{6}$$

On an assumption that, in Euler's belt theory, a belt corresponds to the original and a pulley corresponds to the tip R of the shutter claw 22 (fixed pulley), the tension $F_1$ to the downstream side in the original-conveying direction and the tension $F_2$ to the upstream side in the original-conveying direction are represented by the following Formula (7) and the following Formula (8). In the following Formula (7) and the following Formula (8), a symbol p represents a frictional coefficient between the original and the shutter claw 22.

$$F_1=[e^{\mu\theta}/(e^{\mu\theta}-1)]\cdot F \tag{7}$$

$$F_2=[1/(e^{\mu\theta}-1)]\cdot F \tag{8}$$

When Formula (7) and Formula (8) are substituted into the above-mentioned Formula (6), Formula (6) is represented by the following Formula (9).

$$1<[(e^{\mu\theta}+1)/(e^{\mu\theta}-1)]\cdot\cos[(\pi-\theta)/2]\cdot\tan\alpha-M_S/(r\cdot F\cos\alpha) \quad (9)$$

When Formula (9) is established, in a case where the original P is pulled out to the upstream side in the original-conveying direction during jamming treatment, the registration shutter 21 does not rotate to the direction indicated by the arrow B, which is the direction opposite to the direction indicated by the arrow C. Thus, if, for example, the length r of the shutter claw 22 and the shape and the material of the registration shutter 21 are set so that Formula (9) is established, it is possible to prevent the registration shutter 21 from rotating to the direction indicated by the arrow B when the original is pulled out. Therefore, even when the original is upwardly pulled out, it is possible to pull out the original while preventing the registration shutter 21 from rotating to the direction indicated by the arrow B. As a result, when the original is upwardly pulled out, there is no possibility that the registration shutter 21 bites in between the nip between the original and the conveying roller pair 2, which interferes with pulling out of the original.

In this embodiment, the length r of the shutter claw 22 is set to 10.84 mm. In a case of this embodiment, according to measurement, the winding angle θ was 14.33°, the angle α was 40.94°, the tension $F_1$ to the downstream side was 8N, the frictional coefficient μ was 0.7, and the helical torsion coil spring moment $M_S$ was 0.5 Nmm. By substituting those values into Formula (9), a formula 1<1.188 is obtained. In this case, it is possible to pull out the original while preventing the registration shutter 21 from rotating to the direction indicated by the arrow B.

As described above, when the original P is pulled out to the upstream side in the original-conveying direction, it is possible to pull out the original P while preventing the registration shutter 21 from rotating to the same direction of the original P. With this, it is possible to improve the jamming treatment performance in the registration shutter unit 20. The above-mentioned structure of the registration shutter unit 20 enables the reduction in space and cost of the ADF 60.

Although the above description is made of the case where the present invention is used in the ADF 60 of the image-reading apparatus 50, the present invention is not limited thereto. For example, in an image forming apparatus including an image forming portion, the sheet-conveying apparatus of the present invention may be used as a sheet-conveying apparatus for conveying a sheet to the image forming portion. In addition, in an image forming apparatus including an image-reading portion and an image forming portion for forming an image based on information of the original read by the image-reading portion, the sheet-conveying apparatus of the present invention may be used as a sheet-conveying apparatus for conveying a sheet to the image-reading portion.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2009-163762, filed Jul. 10, 2009, which is hereby incorporated by reference herein in its entirety.

What is claimed is:

1. A sheet-conveying apparatus, comprising:

a pair of rotary members that conveys a sheet;

a skew-feeding correction member that is provided to be rotatable coaxially with one rotary member of the pair of rotary members, that has an abutting portion with which a leading edge of the sheet conveyed toward the pair of rotary members is brought into contact for skew-feeding correction, and that is pressed by the conveyed sheet to rotate; and a positioning portion that has a biasing member for biasing the skew-feeding correction member to a direction opposite to a direction to which the skew-feeding correction member is pressed by the sheet to rotate, and that positions the skew-feeding correction member at a stand-by position at which the abutting portion abuts against the sheet upstream in a sheet-conveying direction with respect to a nip portion of the pair of rotary members, wherein the sheet-conveying apparatus is set so that, in order to pull out the sheet while preventing the skew-feeding correction member from rotating to a direction opposite to the sheet-conveying direction together with the sheet to be pulled out when the stopped sheet is pulled out to the direction opposite to the sheet-conveying direction under a state in which the skew-feeding correction member is caused to rotate from the stand-by position, the following formula is established:

$$M+M_S<M_A$$

wherein a moment generated in the skew-feeding correction member due to a resultant force of a tension to an upstream side in the sheet-conveying direction and of a tension to a downstream side in the sheet-conveying direction when the sheet is pulled out is assumed to be $M_A$, wherein a moment generated in the skew-feeding correction member due to a frictional force between the skew-feeding correction member and the sheet when the sheet is pulled out is assumed to be M, and wherein a moment generated in the skew-feeding correction member due to the biasing member when the sheet is pulled out is assumed to be $M_S$.

2. A sheet-conveying apparatus according to claim 1, wherein the sheet-conveying apparatus is set so that the following formula is established:

$$1<[(e^{\mu\theta}+1)/(e^{\mu\theta}-1)]\cdot\cos[(\pi-\theta)/2]\cdot\tan\alpha-M_S/(r\cdot F\cos\alpha)$$

wherein a straight line, which links a power point of the resultant force of the tension to the upstream side in the sheet-conveying direction and of the tension to the downstream side in the sheet-conveying direction when the sheet is pulled out and a rotational center of the skew-feeding correction member, is assumed to be r, wherein a winding angle at which the sheet is wound around the abutting portion is assumed to be θ, wherein an angle formed by the straight line r and the resultant force is assumed to be α, wherein a frictional coefficient between the sheet and the abutting portion is assumed to be μ, and wherein a frictional force in a tangential direction of a tip of the abutting portion is assumed to be F.

3. A sheet-conveying apparatus according to claim 1, further comprising a curved sheet-conveying path in which the pair of rotary members and the skew-feeding correction member are arranged and through which the conveyed sheet passes, wherein the one rotary member of the pair of rotary members provided with the skew-feeding correction member is arranged in an inside of the curved sheet-conveying path.

4. An image-reading apparatus, comprising:

an image-reading portion that reads an image of a sheet;

a pair of rotary members that conveys the sheet to the image-reading portion;

a skew-feeding correction member that is provided to be rotatable coaxially with one rotary member of the pair of rotary members, that has an abutting portion with which a leading edge of the sheet conveyed toward the pair of rotary members is brought into contact for skew-feeding correction, and that is pressed by the sheet to rotate; and a positioning portion that has a biasing member for biasing the skew-feeding correction member to a direction opposite to a direction to which the skew-feeding correction member is pressed by the sheet to rotate, and that positions the skew-feeding correction member at a stand-by position at which the abutting portion abuts against the sheet upstream in a sheet-conveying direction with respect to a nip portion of the pair of rotary members, wherein the image-reading apparatus is set so that, in order to pull out the sheet while preventing the skew-feeding correction member from rotating to a direction opposite to the sheet-conveying direction together with the sheet to be pulled out when the stopped sheet is pulled out to the direction opposite to the sheet-conveying direction under a state in which the skew-feeding correction member is caused to rotate from the stand-by position, the following formula is established:

$$M+M_S<M_A$$

wherein a moment generated in the skew-feeding correction member due to a resultant force of a tension to an upstream side in the sheet-conveying direction and of a tension to a downstream side in the sheet-conveying direction when the sheet is pulled out is assumed to be $M_A$, wherein a moment generated in the skew-feeding correction member due to a frictional force between the skew-feeding correction member and the sheet when the sheet is pulled out is assumed to be M, and wherein a moment generated in the skew-feeding correction member due to the biasing member when the sheet is pulled out is assumed to be $M_S$.

5. An image-reading apparatus according to claim 4, wherein the image-reading apparatus is set so that the following formula is established:

$$1<[(e^{\mu\theta}+1)/(e^{\mu\theta}-1)]\cdot\cos[(\pi-\theta)/2]\cdot\tan\alpha-M_S/(r\cdot F\cos\alpha)$$

wherein a straight line, which links a power point of the resultant force of the tension to the upstream side in the sheet-conveying direction and of the tension to the downstream side in the sheet-conveying direction when the sheet is pulled out and a rotational center of the skew-feeding correction member, is assumed to be r, wherein a winding angle at which the sheet is wound around the abutting portion is assumed to be θ, wherein an angle formed by the straight line r and the resultant force is assumed to be α, wherein a frictional coefficient between the sheet and the abutting portion is assumed to be μ, and wherein a frictional force in a tangential direction of a tip of the abutting portion is assumed to be F.

6. An image-reading apparatus according to claim 4, further comprising a curved sheet-conveying path in which the pair of rotary members and the skew-feeding correction member are arranged and through which the conveyed sheet passes, wherein the one rotary member of the pair of rotary members provided with the skew-feeding correction member is arranged in an inside of the curved sheet-conveying path.

7. A sheet-conveying apparatus, comprising:

a pair of rotary members that conveys a sheet;

a skew-feeding correction member that is provided to be rotatable coaxially with one rotary member of the pair of rotary members, that has an abutting portion with which a leading edge of the sheet conveyed toward the pair of rotary members is brought into contact for skew-feeding correction, and that is pressed by the conveyed sheet to rotate; and a positioning portion that has a biasing member for biasing the skew-feeding correction member to a direction opposite to a direction to which the skew-feeding correction member is pressed by the sheet to rotate, and that positions the skew-feeding correction member at a stand-by position at which the abutting portion abuts against the sheet upstream in a sheet-conveying direction with respect to a nip portion of the pair of rotary members, wherein when the stopped sheet is pulled out to the direction opposite to the sheet-conveying direction under a state in which the skew-feeding correction member is caused to rotate from the stand-by position, the following formula is established:

ti $M+M_S<M_A$ wherein a moment generated in the skew-feeding correction member due to a resultant force of a tension to an upstream side in the sheet-conveying direction and of a tension to a downstream side in the sheet-conveying direction when the sheet is pulled out is assumed to be $M_A$, wherein a moment generated in the skew-feeding correction member due to a frictional force between the skew-feeding correction member and the sheet when the sheet is pulled out is assumed to be M, and wherein a moment generated in the skew-feeding correction member due to the biasing member when the sheet is pulled out is assumed to be $M_S$.

8. A sheet-conveying apparatus according to claim 7, further comprising a curved sheet-conveying path in which the pair of rotary members and the skew-feeding correction member are arranged and through which the conveyed sheet passes, wherein the one rotary member of the pair of rotary members provided with the skew-feeding correction member is arranged in an inside of the curved sheet-conveying path.

* * * * *